US005439238A

United States Patent [19]

Neal

[11] Patent Number: 5,439,238

[45] Date of Patent: Aug. 8, 1995

[54] BRAKING SYSTEM FOR IN-LINE ROLLER SKATES

[76] Inventor: Stuart Neal, No. 9, Bonneville Dr., Council Bluffs, Iowa 51503

[21] Appl. No.: 140,422

[22] Filed: Oct. 25, 1993

[51] Int. Cl.[6] ..... A63C 17/14

[52] U.S. Cl. ..... 280/11.2; 280/11.22; 188/5

[58] Field of Search ..... 280/11.2, 11.22, 811, 280/11.23; 188/5

[56] References Cited

U.S. PATENT DOCUMENTS

| | | | |
|---|---|---|---|
| 321,261 | 6/1885 | Turnbull | 280/11.2 |
| 1,371,623 | 3/1921 | Ickenroth | 280/11.2 |
| 1,628,004 | 5/1927 | Stetson | 280/11.2 |
| 1,801,205 | 4/1931 | Mirick | 280/11.2 |
| 2,865,220 | 12/1958 | Bayley | 74/501.6 |
| 4,076,266 | 2/1978 | Krausz | 280/11.2 |
| 4,295,547 | 10/1981 | Dungan | 280/11.2 |
| 4,300,781 | 11/1981 | Riggs | 280/11.2 |
| 4,805,936 | 2/1989 | Krantz | 280/11.2 |
| 4,811,620 | 3/1989 | Old et al. | 74/501.6 |
| 4,943,075 | 7/1990 | Gates | 280/11.2 |
| 5,211,409 | 5/1993 | Mitchell et al. | 280/11.2 |
| 5,253,882 | 10/1993 | Mitchell | 280/11.2 |
| 5,280,930 | 1/1994 | Smathers et al. | 280/11.2 |

FOREIGN PATENT DOCUMENTS

| | | | |
|---|---|---|---|
| 2632555 | 2/1978 | Germany | 280/11.2 |

*Primary Examiner*—Margaret A. Focarino
*Assistant Examiner*—Carla Mattix
*Attorney, Agent, or Firm*—John A. Beehner

[57] ABSTRACT

A braking system for an in-line roller skate includes a generally U-shaped brake bracket and a brake pad mounted thereon. The brake bracket is pivotably mounted on the wheel bracket of the in-line roller skate such that the bracket pivots about a generally transverse horizontal pivot axis. A brake actuator including a handle and lever is provided. A cable extends between and is connected to the brake actuator and the brake pad, the cable operative to pivot the brake bracket upon engagement of the brake actuator, thus causing the brake pad to frictionally engage a wheel of the skate. Finally, a spring extends between and is connected to the brake bracket and the shoe of the in-line skate, the spring operative to bias the brake bracket away from the wheel of the skate thereby stopping frictional engagement between the brake pad and the wheel.

15 Claims, 7 Drawing Sheets

BRAKING SYSTEM FOR IN-LINE ROLLER SKATES

BACKGROUND OF THE INVENTION

1. Technical Field

The present invention relates generally to braking systems for skates and, more particularly, to a braking system for in-line roller skates which biases a brake pad against at least one wheel of an in-line roller skate.

2. Description of the Prior Art

Roller skates of the present day bear little resemblance to those roller skates of the past. Present-day roller skates mostly resemble ski boots having a line of plastic wheels down the center of the sole. Originally developed as training aids for hockey players and speed skaters, they are now used by people of all ages and of all occupations, and are most commonly known as Roller Blades after the prototypical brand that dominates the market.

Many users of the in-line skates find that "blading" is an excellent form of aerobic exercise. An hour on skates consumes almost as many calories as an hour of running or cycling, but without the pavement-pounding that running entails. Skates may be used for almost any kind of cross-training, but are particularly useful for people who run more than three times a week as the incidence of foot and leg injuries is greatly reduced by using in-line skates instead of jogging or running.

However, along with the benefits and pleasures gained from the widespread use of in-line roller skates, there are some burdensome problems which have yet to be addressed by the various manufacturers of in-line roller skates. For example, in a story reported originally in the Los Angeles Times, Aug. 1, 1991, at 3, col. 4, a 13-year-old boy was wearing and using his in-line roller skates on a steep section of Pier Avenue in Hermosa Beach, Calif. He raced quickly down the hill, but when he tried to stop at the bottom, he lost control, jumped a curb and slipped under a bus that was crossing the intersection. Paramedics said he was killed instantly. The article further stated that the above-described fatality brought to five the number of in-line skaters killed in accidents nationwide over the period 1986–1991. Skaters say that much of the blame for these accidents falls on the salesmen who do not teach consumers how to properly use the skates. For example, in the case of the 13-year-old boy, the salesman did not go over the skates' potential danger in any detail and failed to show him how to stop.

One further note from the above-mentioned article was that skating experts familiar with that steep section of Pier Avenue said that the 13-year-old boy was probably going about 25 miles per hour, a speed that would have required fancy turning maneuvers or at least 30 feet to stop. It is clear from this article that there is a need for a braking system for these in-line roller skates.

There are examples in the prior art of braking systems provided for roller skates. For example, Riggs, U.S. Pat. No. 4,300,781, discloses a braking system for roller skates which engages brake pads with the wheels of the roller skate upon the pulling of a handle 72. However, it should be obvious from examining the Riggs invention that Riggs does not provide for coordinated braking of two skates. Instead, a user of Riggs would have to operate simultaneously two handles 72 to brake two skates, as the invention is disclosed in the Riggs patent. As this would mandate use of both hands, the balance of the user of the roller skates would be severely compromised, and as the majority of people have one hand stronger than the opposite hand, uneven braking would result. This could further disrupt the balance of the skater, causing a dangerously unbalanced situation from which a fall may result. Furthermore, it is clear that the invention of Riggs cannot be adapted for use on an in-line skate as the braking mechanism of Riggs is positioned between the wheels of the traditional roller skate. On in-line roller skates, the wheels are too close together to allow such a braking system, and therefore Riggs could not be used on an in-line roller skates.

Other braking systems for skates have been suggested (see Ickenroth, U.S. Pat. No. 1,371,623, Krausz, U.S. Pat. No. 4,076,266 or Gates, U.S. Pat. No. 4,943,075) but for various reasons all of these prior art devices are unusable with in-line roller skates presently being manufactured. There is therefore a need for a braking system which may be used with modern in-line roller skates.

Therefore, an object of the present invention is to provide a braking system for an in-line roller skate.

Another object of the present invention is to provide a braking system for an in-line roller skate which provides a brake bracket and brake pad mounted on the brake bracket, the brake bracket pivotable to contact at least one wheel of the in-line roller skates.

Another object of the present invention is to provide a braking system for an in-line roller skate which will not interfere with use of the in-line roller skates.

Another object of the present invention is to provide a braking system for an in-line roller skate which will provide equal braking action to a pair of in-line roller skates through the use of a single brake actuator to enable a user to keep his or her balance.

Another object of the present invention is to provide a braking system for an in-line roller skate which may be quickly and easily installed on an already produced pair of in-line roller skates.

Another object of the present invention is to provide a braking system for an in-line roller skate which will allow even novice users of "roller blades" to quickly come to a stop without requiring intricate turning maneuvers or other such difficult braking maneuvers.

Finally, an object of the present invention is to provide a braking system for and in-line roller skate which is relatively simple to manufacture, easy to install and is safe and efficient in use.

SUMMARY OF THE INVENTION

The braking system of the present invention is designed for use with an in-line roller skates having a shoe portion and a longitudinally extended wheel bracket, the wheel bracket being mounted on the underside of the shoe portion. The in-line skate further includes at least two ground-engaging wheels mounted on the wheel bracket in-line for rotation about generally parallel transverse axes.

The braking system includes a wheel-engaging structure which consists of a generally U-shaped brake bracket including a base section and two arms projecting forwardly therefrom. The brake bracket is pivotably mounted on a wheel bracket adjacent a wheel by pivotably attaching each of the arms to the wheel bracket such that the bracket pivots about a generally horizontal pivot axis. The wheel engaging structure further includes a brake pad mounted on the brake bracket.

A cable bracket is provided which is mounted on an in-line roller skate spaced from the brake bracket. Furthermore, a brake actuator such as a handle having a lever portion is included. A cable extends between the brake actuator and the wheel-engaging structure, the cable operative to pivot the brake bracket and thus the brake pad to frictionally engage a wheel of the skate upon engagement of the brake actuator. The cable further includes a brake cable and an outer sheath surrounding the brake cable, the brake cable extending between and connected to the brake actuator and the wheel-engaging structure and the outer sheath extending between and connected to the brake actuator and the cable bracket such that the brake cable is biased against the cable bracket for engaging the brake pad with a wheel. Finally, a spring is connected between the wheel-engaging structure and the shoe portion of the skate for biasing the brake bracket away from a wheel of the skate thereby stopping frictional engagement between the brake pad and the wheel.

The invention also includes a Y-connector for connecting the cables coming up from each of the skates to a single cable leading to the brake actuator such that engagement of the brake actuator results in equal braking action for both wheel-engaging structures on each in-line skate. This Y-connector should be above the legs of the user to allow for free movement during skating without interference from the cables of the invention. This can result in unbalancing of the user of the skates, thus increasing the likelihood of accident or mishap. As this invention provides for equal braking on both in-line skates and further provides an easily attachable braking system for already produced in-line roller skates, it is clear that the present invention provides a substantial improvement over the prior art.

DESCRIPTION OF THE PREFERRED EMBODIMENT

Figure 1:
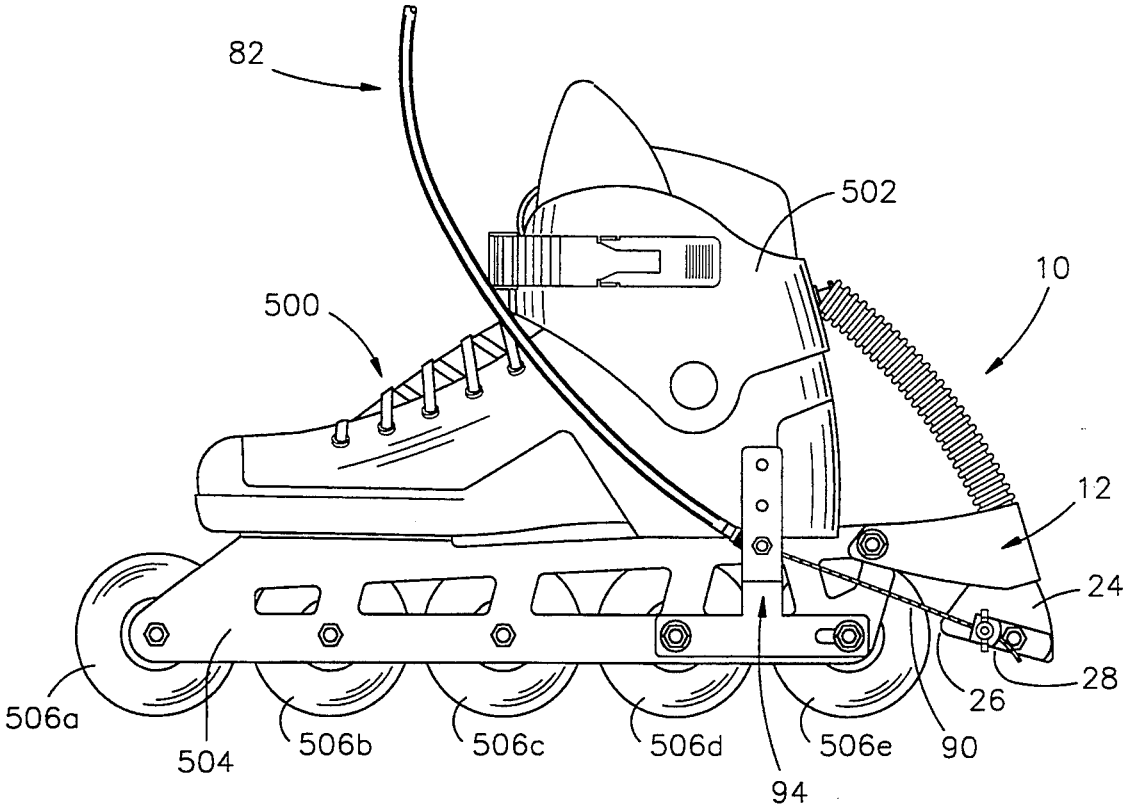
FIG. 1 a side elevational view of an in-line roller skate with the present invention mounted thereon adjacent the rearmost wheel of the in-line roller skate.
Figure 2:
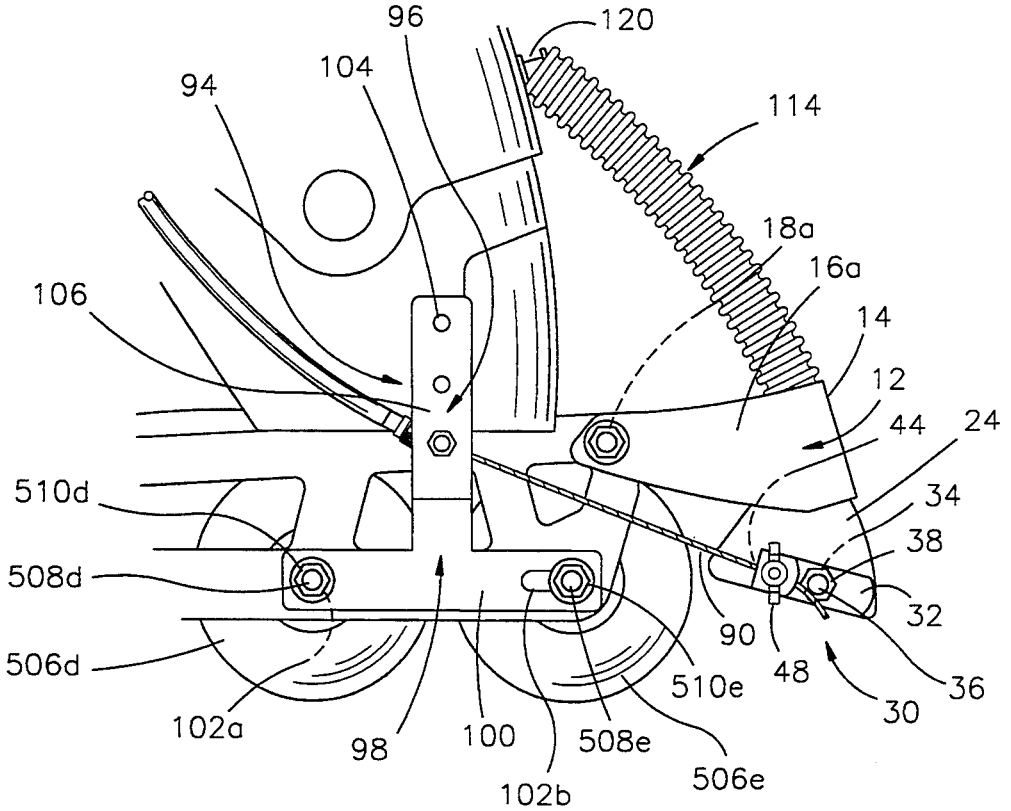
FIG. 2 is a partial detail side elevational view of the skate of FIG. 1 showing the braking system in greater detail.
Figure 3:
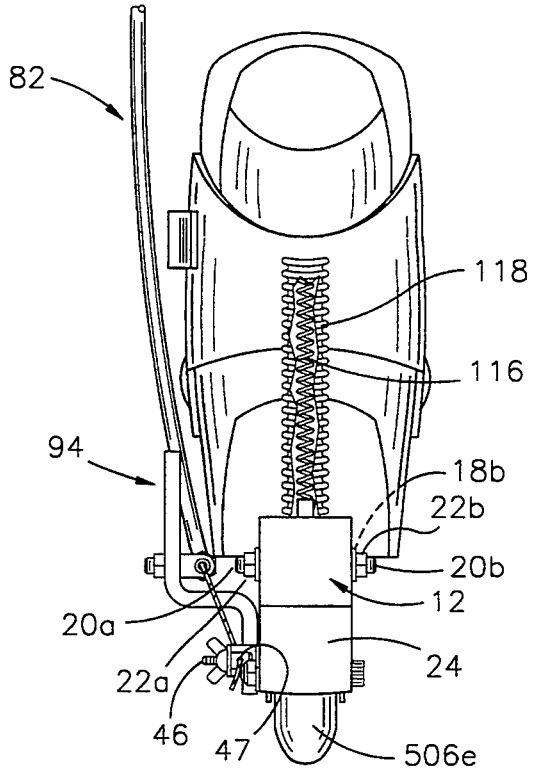
FIG. 3 is a rear elevational view showing a partial cutaway of the biasing device for disengaging the brake pad from the rearmost wheel.
Figure 4:
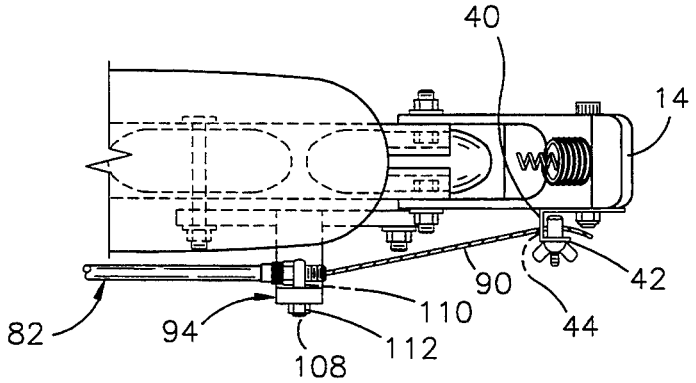
FIG. 4 is a partial detail top plan view of the braking system of the present invention.
Figure 5:
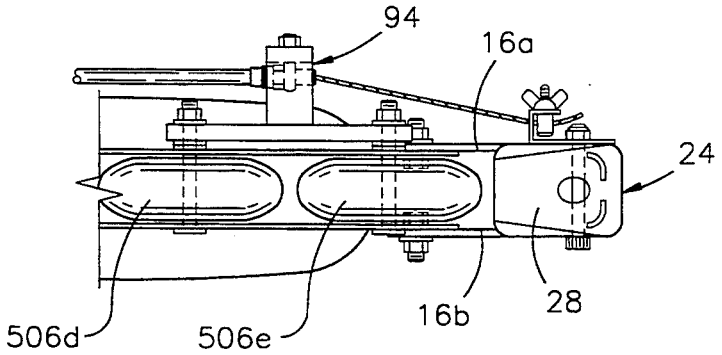
FIG. 5 is a partial detail bottom plan view of the braking system.

The braking system 10 of the present invention is shown in its preferred embodiment in FIGS. 1–6 as being mounted on a conventional in-line roller skate 500 which includes a shoe portion 502 and a longitudinally extended wheel bracket 504. Rotatably mounted on the wheel bracket 504 are a plurality of wheels 506A–E which are mounted in line as shown in FIGS. 3 and 5. It is preferred that the in-line skate 500 be of a standard design such as that presently produced by several in-line skate manufacturers. The shoe portion 502 is preferably constructed of a hard plastic and the wheel bracket 504 is preferably constructed of a high tensile strength steel. It is to be understood, however, that the braking system 10 of the present invention may be used with a variety of types of in-line skates, any of which would be understood and recognized by those skilled in the art. The following description is directed to the left in-line skate 500, however it is to be understood that the features described on the left in-line skate 500 are substantially duplicated on the right in-line skate 501.

The braking system 10 is shown in FIGS. 1–5 as including a U-shaped brake bracket 12 which is pivotably mounted to the rear portion of the wheel bracket 504. It is preferred that the brake bracket 12 be constructed of a generally rigid material such as a hardened plastic or metal. As is best shown in FIG. 5, the U-shaped brake bracket 12 includes a base section 14 and a pair of arms 16A and 16B which extend forwardly from and are connected to the base section 14. The arms 16A and 16B include transverse holes 18A and 18B which enable the brake bracket 12 to be connected to the rear portion of the wheel bracket 504 above the axis of rotation of the rearmost wheel 506E. The brake bracket 12 is pivotably and securely mounted on the wheel bracket 504 by a pair of bolts 20A and 20B which extend through opposite sides of the wheel bracket 504, each extending through a respective transverse hole 18A and 18B, each bolt 20A and 20B being secured in place by nylon bushings 22A and 22B, as shown in FIG. 4. The nylon bushings 22A and 22B allow the bolts 20A and 20B to be securely fastened in place, yet allow the brake bracket 12 to freely pivot about a substantially horizontal transverse pivot axis generally defined by the bolts 20A and 20B.

Mounted on the brake bracket 12 and depending downwards therefrom is a brake pad 24 preferably constructed of synthetic rubber or polyurethane. It is preferred that the brake pad 24 be connected to the brake bracket 12 adjacent the base section 14 of the brake bracket 12 and between the arms 16A and 16B, the connection being made by either a sturdy glue or a screw (not shown) extending from the brake pad 24 into the brake bracket 12.

As shown most clearly in FIG. 2, the brake pad 24 has a generally triangular cross-sectional shape including a leading wheel-contacting edge 26 which contacts the rearmost wheel 506E when the brake bracket 12 is pivoted downwards. The brake pad 24 also includes a base surface 28.

Mounted on the brake pad 24 is a cable attachment bracket 30 which includes an attachment bar 32 having a hole 34 for receiving a bolt 36 which extends through the hole 34, through the brake pad 24 and is secured in place by a nylon bushing 38. The attachment bar 32 may thus pivot about the axis defined by the bolt 36. Extending outwards from one end of the attachment bar 32 and mounted thereon is a spacer strut 40, the spacer strut 40 providing support for a bolt bar 42 which extends rearwards from the outer end of the spacer strut 40 generally parallel with the attachment bar 32. In a preferred embodiment, the spacer strut 40 would include a hole 44 through which a brake cable 90 would extend. For securing the lower brake cable 90 to the cable attachment bracket 30, a bolt 46 extends through the bolt bar 42, the bolt 46 including a cable-receiving hole 47 through which the lower brake cable 90 may be passed. A wing nut 48 is threaded onto the bolt 46 on the outer side of the bolt bar 42 as shown in FIG. 3, the wing nut 48 operative to draw the bolt 46 outwards, thus closing off the hole 47 and crimping and gripping the lower brake cable 90 extending therethrough. In this manner, the distance between the rearmost wheel 506E and the leading edge 26 of the brake pad 24 may be increased or decreased by adjusting the position at which the lower brake cable 90 is gripped.

Figure 6:
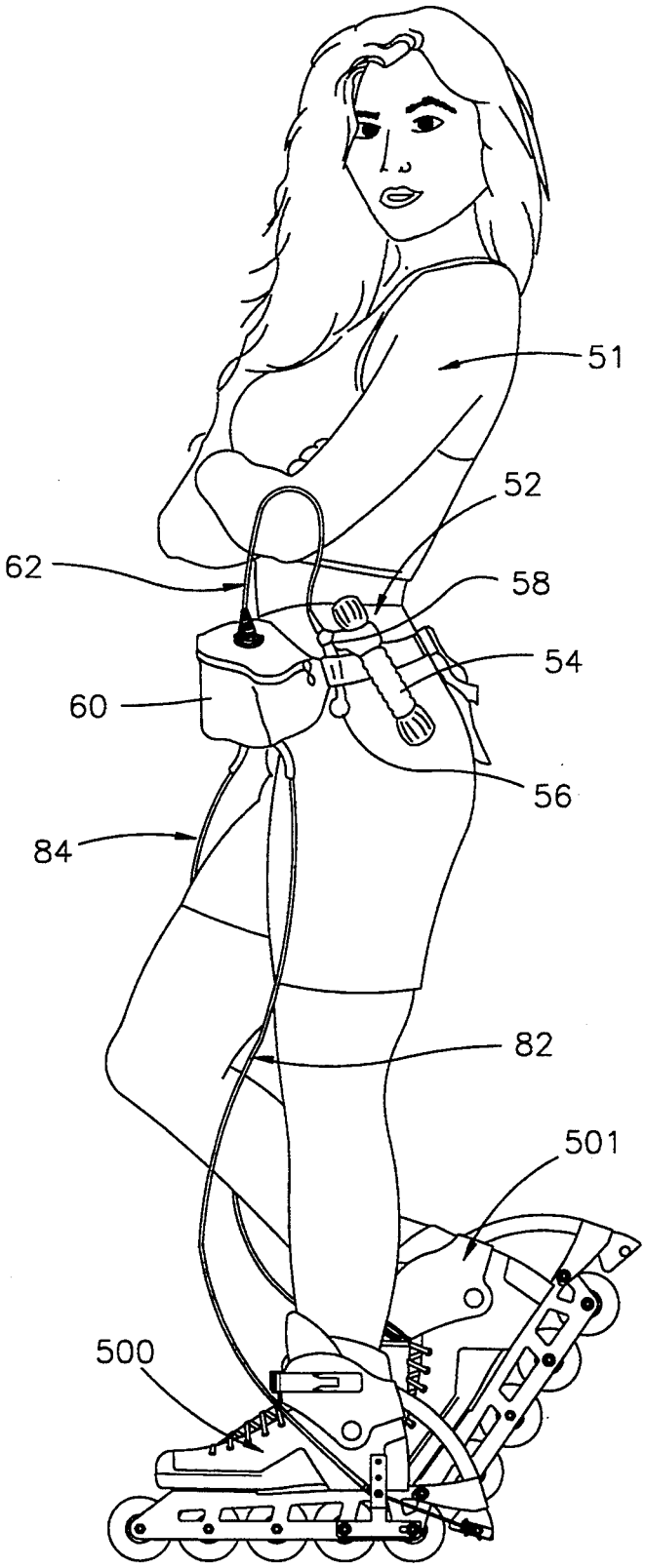
FIG. 6 is a perspective view of a person wearing in-line skates including the braking system of the present invention.
Figure 7:
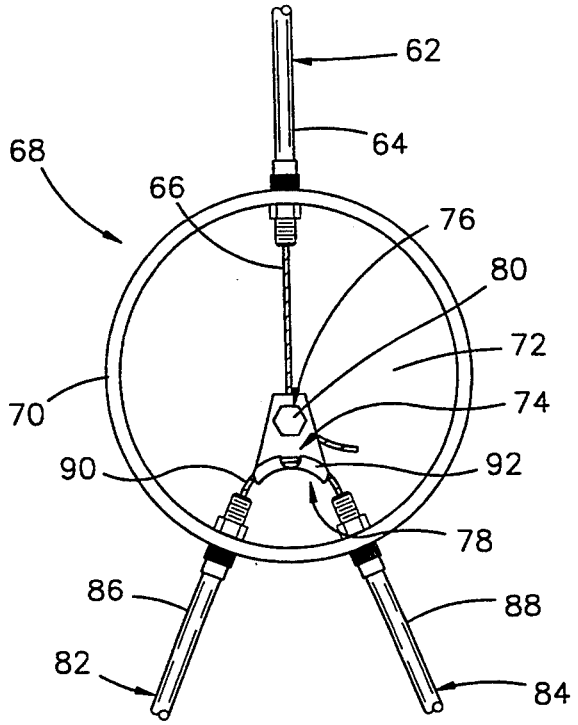
FIG. 7 is a partial detail front elevational view of the connection between the upper brake cable and lower brake cable.

The actuating mechanism for bringing the brake pad 24 into contact with the rearmost wheel 506E is shown most clearly in FIGS. 6 and 7 as positioned on a user 51 of the system 10 as including a brake actuator 52 which includes a handle portion 54 and a lever portion 56, the lever portion 56 being pivotably mounted on the handle portion 54. The handle portion 54 further includes an outwardly extending handle strut 58 on which the lever portion 56 is pivotably mounted. It is preferred that the lever portion 56 be pivotable about an axis generally perpendicular to the longitudinal axis of the handle portion 54 such that the lever portion 56 may be pivoted by a normal hand-squeezing motion.

Extending from the handle strut 58 into the hip bag 60 is an upper cable 62 which includes an upper cable outer sheath 64 and upper brake cable 66, as shown in FIG. 7.

FIG. 7 displays the circular cable connection container 68 which resides within the hip bag 60. The container 68 is preferably a substantially rigid plastic container having a rigid circular outer wall 70 and strengthening base section 72, the base section 72 extending across and connected to an edge of the circular wall 70. Held within the cable connection container 68 is a Y-connector 74 which is generally triangular in shape and includes upper and lower brake cable connectors 76 and 78.

The connection between the brake actuator 52 and Y-connector 74 is as follows: upper brake cable 66 extends between and is connected to the lever portion 56 of the brake actuator 52 and the upper brake cable connector 76 of the Y-connector 74. The upper cable outer sheath 64 extends between the handle strut 58 of the brake actuator 52 and the circular wall 70 of the cable connection container 68. Therefore, when the lever portion 56 of the brake actuator 52 is pivoted, the upper brake cable 66 is tensioned and pulls against the Y-connector 74. Due to the stiffness of the outer sheath 64, the Y-connector 74 is pulled upwards relative to the outer sheath 64, as shown in FIG. 7. In this manner, the pivoting action of the lever portion 56 of the brake actuator 52 is translated into upward motion of the Y-connector 74.

It is preferred that the connection of the outer sheath 64 to the circular wall 70 and to the handle strut 58 be accomplished by threaded connections to each of the above mentioned elements, however, it is to be understood that the exact nature of the connection is not critical to the invention. Likewise, the connection of the upper brake cable 66 to the Y-connector 74 would preferably consist of the upper brake cable connector 76 including a bolt 80 and a nut (not shown) which threadably connects to the bolt on the opposite side of the Y-connector 74 securing the upper brake cable 66 between the nut and the surface of the Y-connector 74. Similarly, the connection of the upper brake cable 66 to the lever portion 56 would be by a bolt and nut combination, although as long as this connection is strong its exact nature is not critical to this invention.

Left and right lower cables 82 and 84 are shown most clearly in FIGS. 6 and 7 as including left and right lower outer sheaths 86 and 88 and a lower brake cable 90. It is preferred that the lower brake cable 90 be a unitary brake cable extending between the left and right in-line roller skates 500 and 501 in order to provide for equal braking on both the left and right skates 500 and 501. The lower brake cable 90 would then be connected to the Y-connector 74 at the lower brake cable connector 78 which consists of a curved hook section 92 which may be crimped to secure the lower brake cable 90 within the curved section 92, as shown in FIG. 7. Of course, the lower brake cable 90 need not be a single unitary cable but instead may be two separate cables, but it is preferred that a single cable be used for increased structural strength of the cable system.

For clarity, the lower cable system will be described in connection with only the left in-line roller skate 500, as this skate is most clearly shown in FIGS. 1–5. It is to be understood, however, that the right in-line roller skate 501 would include a substantially similar cable system. The left outer sheath 86 of the left lower cable 82 extends between the circular wall 70 of the connection container 68 downwards to connect to a cable bracket 94 which is mounted on the wheel bracket 504, as shown in FIGS. 1 and 2.

The cable bracket 94 is preferably constructed as including a generally L-shaped upper bracket portion 96 and a generally T-shaped lower bracket portion 98. The cable bracket 94 is most clearly shown in FIGS. 2 and 3, and is preferably mounted on the wheel bracket 504 with the crossbar 100 of the T-shaped lower bracket portion 98 connected to two of the bolts 508D and 508E securing wheels 506D and 506E to the wheel bracket 504. For this purpose, the crossbar 100 includes slots 102A and 102B which allow wheel securement bolts 508D and 508E to extend therethrough and be secured by nuts 510D and 510E. In this manner, the cable bracket 94 may be securely fastened to the wheel bracket 504. When the cable bracket 94 is secured to the wheel bracket 504 in the above-described manner, the L-shaped upper bracket portion 96 extends outwards and upwards from the T-shaped lower bracket portion 98, as shown in FIG. 3. It is important that the cable bracket 94 be constructed of high-tensile steel to resist deformation, as the bracket 94 is subjected to a great deal of stress during braking.

A plurality of holes 104 are provided extending through the vertical bar 106 of the L-shaped upper bracket portion 96. These holes 104 provide a plurality of mounting points for the outer sheath 86 of the lower cable 82, as shown in FIG. 2. A bolt 108 having a threaded eye 110 is provided for securement in one of the holes 104 by a nut 112, as shown in FIGS. 3 and 4. One end of the outer sheath 86 is threadably connected to the threaded eye 110 of the bolt 108, the bolt being secured in place to provide a sturdy load point such that the lower brake cable 90 may act to pivot the brake bracket 12 to bring the brake pad 24 into contact with the rearmost wheel 506E.

It is important to note that as the upper brake cable 66 is tensioned, thus moving the Y-connector 74 upwards, the lower brake cable 90 is likewise moved upwards thus tensioning both the left and right lower cables 82 and 84 equally. This then provides the equal braking action on both the left and right in-line roller skates 500 and 501. Additionally, it is important that the connection container 68 include the circular wall 70 in order to decrease friction between the lower brake cable 90 and left and right outer sheaths 86 and 88, as the circular wall 70 provides the correct angle between the left and right lower cables 82 and 84.

The final important element of the braking system 10 is the biasing device 114, shown most clearly in FIGS. 1–3. The biasing device 114 extends between and is connected to the shoe portion 502 of the in-line roller skate 500 and the brake bracket 12 and includes a spring 116 surrounded by a protective outer cover 118. It is the spring 116 which is actually connected to the shoe portion 502 and brake bracket 12, with the outer covering 118 preferably being a flexible plastic or rubber compressible ribbed cylinder which expands or contracts along with the spring 116. The biasing device 114 is provided for biasing the brake bracket 12 upwards to prevent frictional contact between the brake pad 24 and rearmost wheel 506E. However, it is preferred that the biasing device 114 be of limited strength to enable a user of the braking system 10 to pivot the lever portion 56 of the brake actuator 52 to engage the brake pad 24 with the rearmost wheel 506E without having to exert an overt amount of pressure. The spring 116 may be connected to the shoe portion 502 of the in-line roller skate 500 by any desired means, such as a securement bolt 120, as shown in FIG. 2. Likewise, the spring 116 may be secured to the brake bracket 12 by any desired means.

Figure 13:
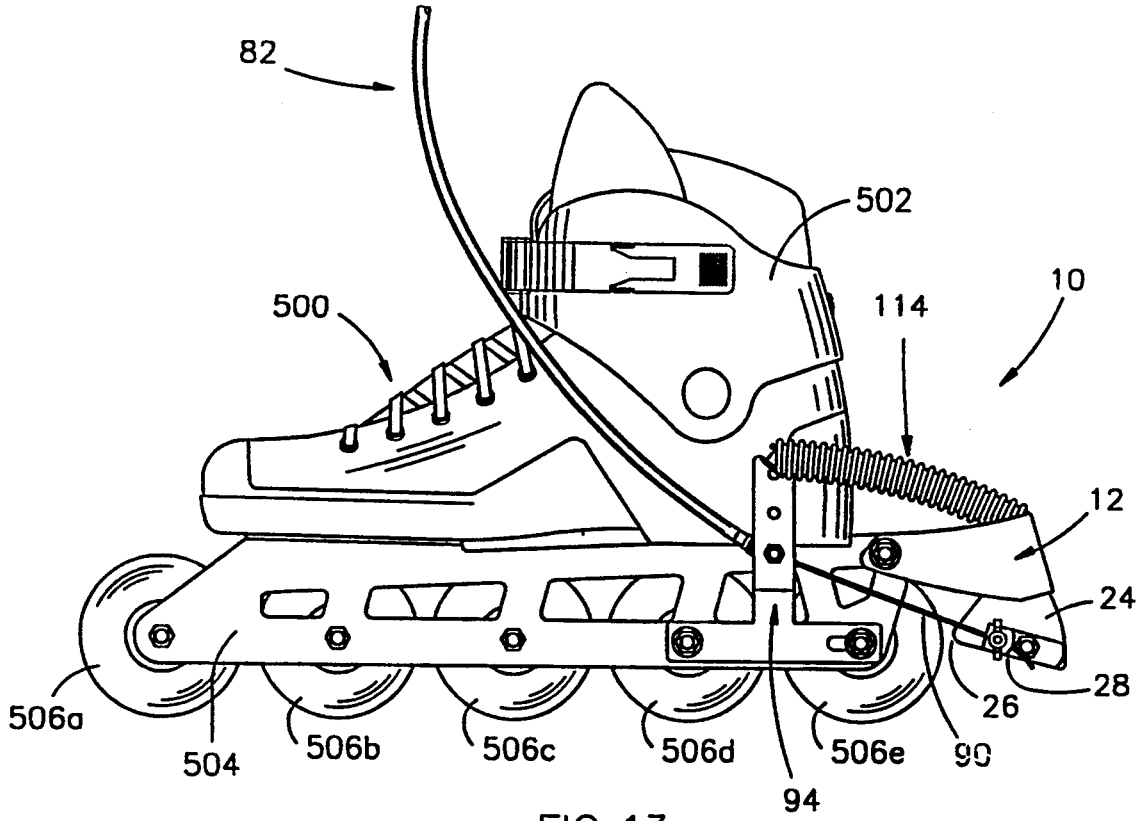
FIG. 13 is a side elevational view of an alternative embodiment of the present invention mounted on an in-line skate.

Alternatively, the spring 116 may extend between the brake bracket 12 and cable bracket 94 to eliminate any need for modifying the shoe portion 502 of the in-line skate 500, as shown in FIG. 13. This enables the braking system 10 to be used on any existing in-line skate 500, regardless of the construction material or structure of the shoe portion 502 of the in-line skate 500.

Figure 12:
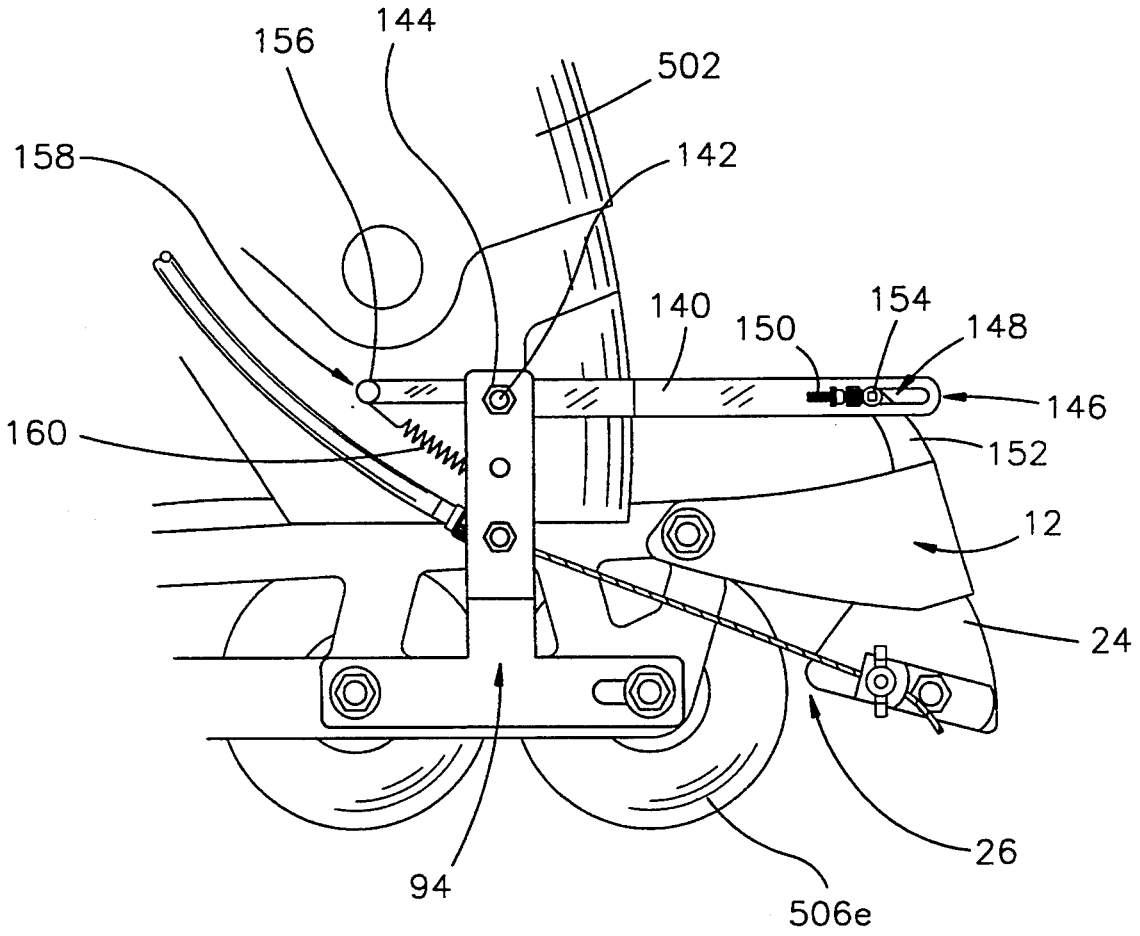
FIG. 12 is a partial detail side elevational view of an alternative embodiment of the biasing device for disengaging the brake pad from the rearmost wheel.

It is also contemplated to replace the spring described above with a pivot bar 140, as shown in FIG. 12. The pivot bar 140 is pivotably mounted on the cable bracket 94 by a bolt 142 and nylon bushing 144. The rearward end 146 of the pivot bar 140 includes a slot 148 and a positioning screw 150 mounted adjacent to and aligned with the longitudinal axis of the slot 148. A strut 152 extends upward from and is connected to the brake bracket 12, the strut 152 further including an outwardly extending slot-engaging bar 154 which fits into and is slidably secured in the slot 158. Pivoting motion of the brake bracket 12 thus results in the slot-engaging bar 154 sliding forward and downwards within the slot 148, thus pivoting the pivot bar 140 relative to bolt 142.

The opposite end of the pivot bar 140 includes a bolt 156 passing transversely through the pivot bar 140 adjacent the forward end 158 of the pivot bar 140. Connected to the bolt 156 and extending downwardly and rearwardly therefrom is a spring 160 which is connected at the opposite end to the cable bracket 94. Therefore, when the pivot bar 140 is pivoted in response to downwards and forwards pivotal motion of the brake bracket 12, the spring 160 biases the pivot bar to swing the rearward end 146 of the pivot bar 140 upwards, thus disengaging the brake pad 24 from the rearmost wheel 506E. The positioning screw 150 may be adjusted to control the distance between the leading wheel contacting edge 26 of the brake pad 24 and the rearmost wheel 506E. In this manner, braking action may be controlled to a greater extent that is possible with those inventions found in the prior art.

Figure 8:
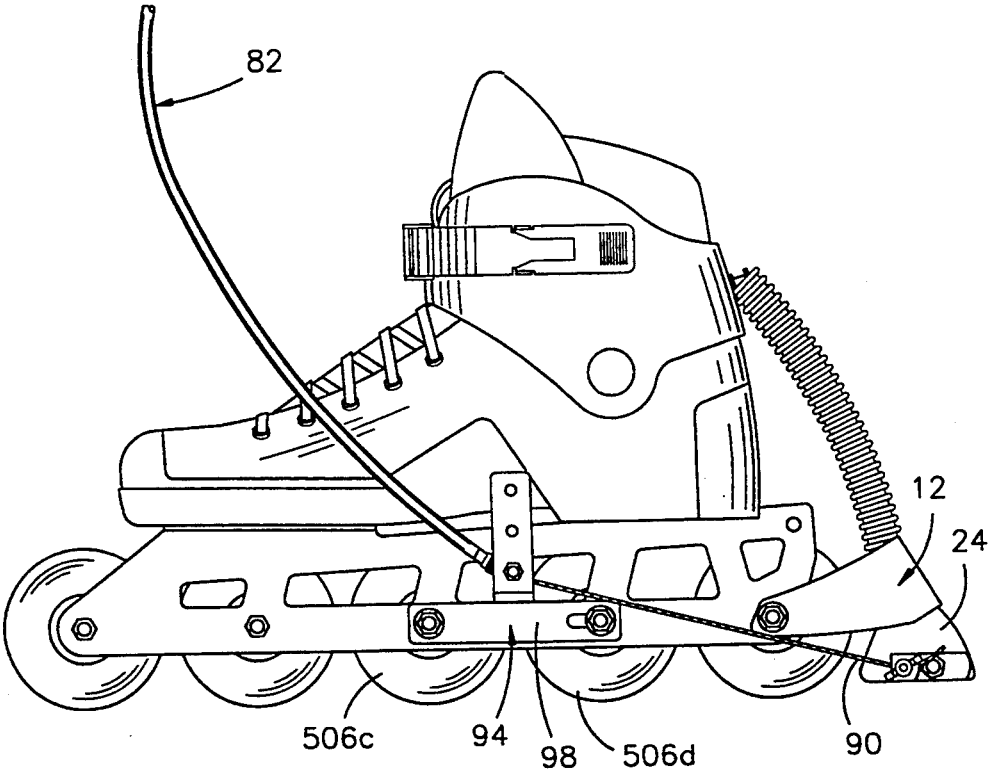
FIG. 8 is a side elevational view of an alternative embodiment of the braking system of the present invention showing the brake bracket mounted such that the axis of rotation of the brake bracket is collinear with the axis of rotation of the rearmost wheel.
Figure 9:
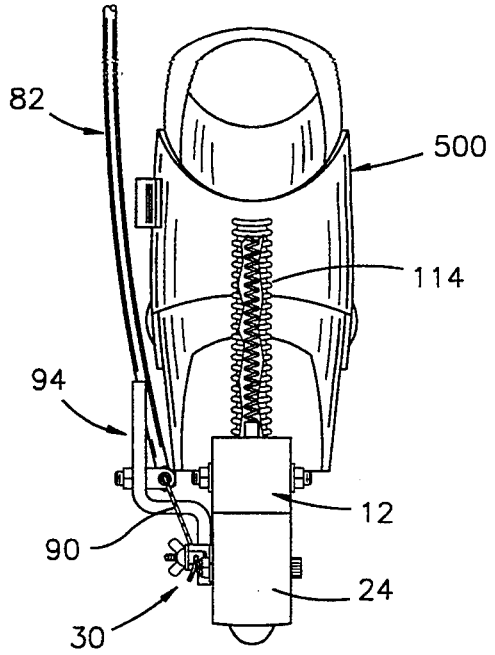
FIG. 9 is a rear elevational view of the embodiment of FIG. 8.

FIGS. 8 and 9 disclose a second embodiment of the braking system 10 of the present invention. The only change which has been effected in this embodiment is that the pivot point of the brake bracket 12 has been moved from the upper portion of the wheel bracket 504 downwards such that the axis of rotation of the brake bracket 12 is collinear with the axis of rotation of the rearmost wheel 506E. This enables the base surface 28 of the brake pad 24 to contact the ground surface over which the in-line skate 500 is traveling before the leading edge 26 of the brake pad 24 contacts the rearmost wheel 506E. For proper functioning, however, the cable bracket 94 must be moved from the fourth and fifth wheels 506D and 506E of the in-line skate 500 to the third and fourth wheels 506C and 506D to provide a load point for the lower brake cable 90 to pull against. Otherwise, the load point would be above the pivot point of the brake bracket 12 thus preventing proper downward pivoting action of the brake bracket 12. Additionally, the cable bracket 94 may be modified to include a T-shaped lower bracket portion 98 having a shorter vertical section than that shown in FIG. 3, to further accommodate the adjusted load point of the lower brake cable 90. Of course, securement of the cable bracket 94 would be achieved in the same manner described previously in connection with wheels 506D and 506E.

Figure 10:
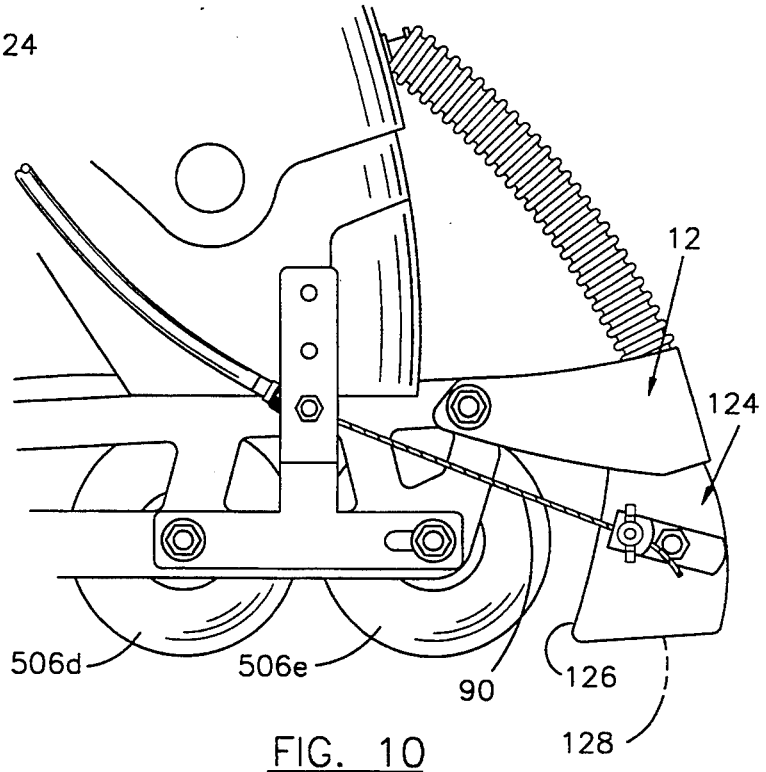
FIG. 10 is a partial detail side elevational view of an alternative embodiment of the braking system of the present invention showing an extended length braking pad for contacting a ground surface.

FIG. 10 exhibits a third embodiment of the braking system 10 of the present invention which is substantially similar to the embodiment of FIG. 1 with only one significant change. In the embodiment of FIG. 10, the brake pad 124 has been lengthened and extended such that pivoting action of the brake bracket 12 induces frictional contact of the base surface 128 of the brake pad 124 with a ground surface prior to contact of the leading edge 126 with the rearmost wheel 506E. Therefore, braking action is initiated by ground contact rather than contact between the brake pad 124 and wheel 506E.

Both of the embodiments of FIGS. 8 and 9 and of FIG. 10 provide several advantages over the embodiment of FIG. 1, the most important being wear of the rearmost wheel 506E is substantially reduced as the brake pad does not contact the wheel for braking maneuvers. However, wear of the brake pad is substantially increased by contact with ground surfaces, as the majority of ground surfaces over which skaters travel are slightly rough and uneven, thus causing increased wearing of the braking pad. Therefore, the enlarged braking pad of FIG. 10 provides for increased life span of the usefulness of the brake pad.

Figure 11:
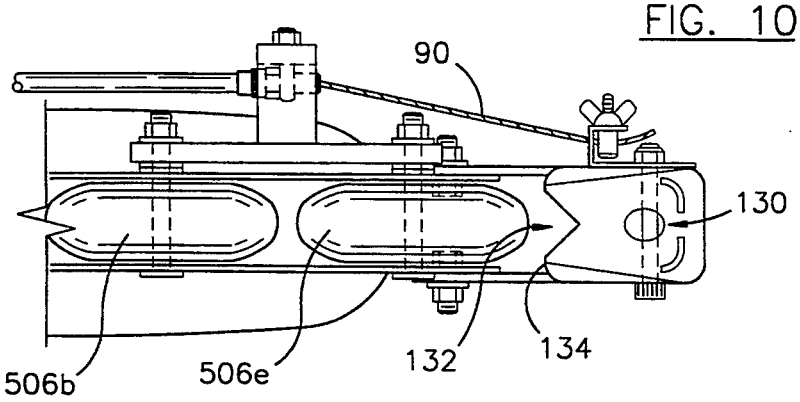
FIG. 11 is a partial detail bottom plan view showing a modified brake pad which contacts the rearmost wheel over a greater surface area to provide increased braking action.

In testing of the invention, it has been found that the standard polyurethane wheel used with in-line roller skates is not of sufficient hardness to withstand frictional contact with the brake pad over an extended period of time. Frictional contact of the brake pad against the wheel results in flattening of the wheel surface, which can severely retard performance of the in-line roller skates. There are two possible solutions to this problem. The first involves replacing the original wheel of the in-line roller skate with a wheel of a substantially harder rubber substance which resists deformation caused by frictional contact with the brake pad. The other alternative is to provide a brake pad 130 as shown in FIG. 11, the brake pad 130 including a generally V-shaped notch 132 formed in the leading edge 134 of the brake pad 130. This generally V-shaped notch 132 is designed to fit over and contact the sides of the wheel 506E, thus decreasing the wear of the wheel at the ground contacting surface of the wheel. Additionally, the generally V-shaped notch 132 enables a greater surface area of the brake pad 130 to engage the wheel 506E, thus increasing the braking efficiency of the braking system. In all other respects, the system of FIG. 11 is similar to the system of FIG. 1.

It is to be understood that the present invention, although described with some degree of particularity, is not to be limited to the embodiments described above. For example, the brake pad may contact more than one wheel at a time by being positioned on the outer edge of the wheel bracket. Furthermore, construction materials of the various parts described herein may be varied, as long as the construction materials used conform to the desired degree of rigidity. Therefore, it is apparent that many modifications, substitutions and additions may be made to the present invention which are within the intended broad scope of the appended claims.

There has thus been shown and described a braking system for in-line roller skates which accomplishes at least all of the stated objectives.

I claim:

1. A braking system for an in-line roller skate having a shoe portion and a longitudinally extended wheel bracket, the wheel bracket mounted on the underside of the shoe portion, the in-line skate further including at least two ground-engaging wheels mounted on the wheel bracket in-line for rotation about generally parallel transverse axes such that one wheel is a rearmost wheel, said braking system comprising;

a wheel engaging structure comprising;

brake pad means;

a brake bracket connected to said brake pad means, said brake bracket including a forwardly extending arm for mounting on the in-line skate wheel bracket adjacent the rearmost wheel;

means for pivotably mounting said arm to the in-line skate wheel bracket above the rotational axis of the rearmost wheel of the in-line skate such that upon said brake bracket being pivoted downwardly and forwardly, said brake pad means is brought into frictional contact with the rearmost wheel;

a brake actuator;

cable means extending between and connected to said brake actuator and said wheel engaging structure, said cable means operative to pivot said brake bracket and said brake bracket and said brake pad means to frictionally engage the wheel of the skate upon engagement of said brake actuator;

biasing means connected to said wheel engaging structure, said biasing means operative to bias said brake bracket away from the wheel of the skate thereby stopping frictional engagement between said brake pad means and the wheel.

2. The braking system of claim 1 wherein said brake pad means comprises a polyurethane brake pad including a leading wheel-contacting edge for contacting and frictionally engaging the wheel of the in-line roller skate.

3. The braking system of claim 1 wherein said brake bracket comprises a generally U-shaped bracket including a base section and two arms projecting forwardly therefrom, said brake pad means being mounted to said brake bracket between said arms and adjacent said base section of said brake bracket.

4. The braking system of claim 1 further comprising cable bracket means and means for mounting said cable bracket means on the in-line roller skate spaced from said brake bracket.

5. The braking system of claim 4 wherein said cable bracket means comprises a generally L-shaped bracket connected to a generally T-shaped mounting bar, the T-shaped mounting bar including a cross bar section having slots formed in opposite ends thereof, said slots adapted to receive bolts for connection to the wheel bracket of the in-line roller skate, said T-shaped section and said L-shaped bracket adapted to be mounted to the wheel bracket such that said L-shaped bracket extends upwards and outwards from said T-shaped section with said cross bar section of said T-shaped section connected to the wheel bracket.

6. The braking system of claim 5 wherein said cable means further comprises a brake cable and an outer sheath surrounding said cable, said brake cable extending between and connected to said brake actuator and said wheel engaging structure, said outer sheath extending between and connected to said brake actuator and said cable bracket means such that said brake cable is biased against said cable bracket means for engaging said brake pad means with a wheel.

7. The braking system of claim 6 wherein said brake actuator comprises a hand-brake mechanism having a handle portion and a lever portion pivotally connected to the handle portion.

8. The braking system of claim 7 wherein said outer sheath of said cable means extends between and is connected to said handle portion of said brake actuator and said cable bracket means and said brake cable of said cable means extends between and is connected to said lever portion of said brake actuator and said brake pad means, such that upon said lever portion of said brake actuator being pivoted, said brake cable is tensioned against said outer sheath of said cable means thereby biasing said brake pad means into frictional contact with a wheel of the in-line roller skate, thus initiating braking action.

9. The braking system of claim 8 wherein said brake pad means further comprises a cable attachment bracket mounted on said brake pad means, said cable attachment bracket including means for releasably and adjustably gripping said brake cable.

10. The braking system of claim 4 wherein said biasing means comprises a spring extending between and connected to said brake bracket and said cable bracket means said spring operative to pivot said brake bracket away from a wheel of the in-line skate thereby stopping frictional engagement between said brake pad means and a wheel.

11. A braking system for a pair of in-line roller skates each having a shoe portion and a longitudinally extended wheel bracket, the wheel bracket mounted on the underside of the shoe portion, each in-line skate further including at least two ground-engaging wheels mounted on the wheel bracket in-line for rotation about generally parallel transverse axes, said braking system comprising:

two wheel-engaging structures each comprising;

brake pad means;

a brake bracket connected to said brake pad means, said brake bracket including a forwardly extending arm for mounting on the in-line skate wheel bracket adjacent the wheel;

means for pivotably mounting said arm to the in-line skate wheel bracket such that said brake bracket pivots about a generally transverse horizontal pivot axis, said brake bracket pivotable to bring said brake pad means into frictional contact with a wheel of the in-line skate;

a brake actuator;

a Y-connector having a single upper end and two lower ends, said Y-connector connected at said single upper end to said brake actuator and each lower end connected to one of said wheel-engaging structures such that upon engagement of said brake actuator, each of said brake brackets are pivoted to bias said brake pad means into frictional engagement with an adjacent wheel of one of the in-line roller skates;

upper cable means extending between and connected to said brake actuator and said single upper end of said Y-connection; and at least two lower cable means, one each extending between and connected to one of said lower ends and one of said wheel-engaging structures.

12. The braking system of claim 11 wherein said lower cable means comprises a single brake cable extending between each of said wheel-engaging structures and being connected adjacent the midpoint of said brake cable to said lower ends of said Y-connector.

13. The braking system of claim 12 wherein said Y-connector comprises a generally triangular bracket which includes a top point having a hole and a lower portion adapted to be connected to said brake cable, said hole in said top point adapted to receive and be connected to said upper cable means whereby connection between said brake actuator and said wheel-engaging structures is accomplished.

14. In combination, an in-line roller skate comprising a shoe portion and a longitudinally extended wheel bracket, the wheel bracket mounted on the underside of the shoe portion, the in-line skate further including at least two ground-engaging wheels mounted on the wheel bracket in-line for rotation about generally parallel transverse horizontal axes; and a braking system comprising:

a wheel-engaging structure including;

a brake bracket pivotably mounted on said wheel bracket adjacent at least one of said wheels;

brake pad means mounted on said brake bracket;

said brake bracket and said brake pad means cooperating such that said brake bracket is pivotable to bring said brake pad means into frictional contact with at least one of said wheels thereby initiating braking action;

a brake actuator;

cable means extending between and connected to said wheel engaging structure and said brake actuator, said cable means operative to pivot said brake bracket and said brake pad means to frictionally engage at least one of said wheels of said skate upon engagement of said brake actuator; and said brake bracket adapted to be pivotably mounted on a wheel bracket above the rotational axis of a rearmost wheel of said in-line skate such that upon said brake bracket being pivoted downwardly and forwardly, said brake pad means is brought into frictional contact with said rearmost wheel.

15. In combination, an in-line roller skate comprising a shoe portion and a longitudinally extended wheel bracket, the wheel bracket mounted on the underside of the shoe portion, the in-line skate further including at least two ground-engaging wheels mounted on the wheel bracket in-line for rotation about generally parallel transverse horizontal axes; and a braking system comprising:

a wheel-engaging structure including;

a brake bracket pivotably mounted on said wheel bracket adjacent at least one of said wheels;

brake pad means mounted on said brake bracket;

said brake bracket and said brake pad means cooperating such that said brake bracket is pivotable to bring said brake pad means into frictional contact with at least one of said wheels thereby initiating braking action;

a brake actuator;

cable means extending between and connected to said wheel engaging structure and said brake actuator, said cable means operative to pivot said brake bracket and said brake pad means to frictionally engage at least one of said wheels of said skate upon engagement of said brake actuator; and said brake bracket adapted to be pivotably mounted on a wheel bracket such that upon said brake bracket being pivoted downwardly, said brake pad means is brought into frictional contact with a ground surface over which said skate is traveling.

* * * * *